US005822358A

United States Patent [19]

Johansen

[11] Patent Number: 5,822,358

[45] Date of Patent: Oct. 13, 1998

[54] METHOD AND APPARATUS FOR PRODUCING SELF-BAKING CARBON ELECTRODE

[75] Inventor: Johan Arnold Johansen, Kristiansand, Norway

[73] Assignee: Elkem ASA, Norway

[21] Appl. No.: 913,515

[22] PCT Filed: Mar. 1, 1996

[86] PCT No.: PCT/NO96/00042

§ 371 Date: Aug. 26, 1997

§ 102(e) Date: Aug. 26, 1997

[87] PCT Pub. No.: WO96/27275

PCT Pub. Date: Sep. 6, 1996

[30] Foreign Application Priority Data

Mar. 2, 1995 [NO] Norway ..... 950808

[51] Int. Cl.[6] ..... H05B 7/09

[52] U.S. Cl. ..... 373/89; 373/97; 373/100

[58] Field of Search ..... 373/88, 89, 90, 373/97, 98, 100

[56] References Cited

U.S. PATENT DOCUMENTS 4,527,329 7/1985 Bruff et al. .
4,575,856 3/1986 Persson .
4,692,929 9/1987 Cavigli et al. .
4,696,014 9/1987 Orrling .

FOREIGN PATENT DOCUMENTS 149451 10/1979 Norway .

*Primary Examiner*—Tu B. Hoang
*Attorney, Agent, or Firm*—Bierman, Muserlian and Lucas

[57] ABSTRACT

This invention relates to a method for continuous production of a self-baking carbon electrode in direct connection with the smelting furnace wherein the electrode is consumed. Blocks of a first unbaked carbonaceous electrode paste are supplied to a curing chamber arranged at the upper end of the electrode, which curing chamber is open at its top and at its bottom and has an inner cross section corresponding to the cross section of the electrode which is to be produced, blocks of the first unbaked carbonaceous paste having a smaller diameter than the inner diameter of the curing chamber, supplying a second particulate unbaked carbonaceous electrode paste to the annulus between the curing chamber and the blocks of the first unbaked carbonaceous electrode paste, second electrode paste comprising a binder which cures at a lower temperature than the first carbonaceous paste by heating means arranged on the curing chamber. The second carbonaceous electrode paste thereby forms a cured shell about the central blocks of the first carbonaceous electrode paste. The central unbaked blocks of the first carbonaceous electrode paste are then baked into a solid carbon electrode together with the cured shell by the heat generated in the area of electric current supply to the electrode. The invention further relates to an apparatus for production of such electrodes.

12 Claims, 2 Drawing Sheets

METHOD AND APPARATUS FOR PRODUCING SELF-BAKING CARBON ELECTRODE

TECHNICAL FIELD

The present invention relates to a method for producing a self-baking carbon electrode for the use in electric smelting furnaces. The invention further relates to an apparatus for production of such electrodes.

BACKGROUND ART

Conventional self-baking electrodes comprise a vertical arranged electrode casing normally made from steel, extending through an opening in the furnace roof or hood. The upper end of the electrode casing is open in order to allow addition of unbaked carbonaceous electrode paste which upon heating softens and melts and is thereafter baked into a solid carbon electrode due to heat evolved in the paste in the area of supply of the electric operating current to the electrode. As the electrode is consumed in the furnace the electrode is lowered and new sections of casing are installed on the top of the electrode column and further unbaked electrode paste is added.

Conventional electrodes of this type are equipped with inner, vertical metallic ribs affixed to the inner surface of the electrode casing which ribs extend radially towards the center of the electrode. When a new section of electrode casing is installed at the top of the electrode column, the ribs are welded to the ribs in the casing below in order to obtain continuous ribs in the vertical direction. The ribs serve as a reinforcement for the baked electrode and to conduct electric current and heat radially into the electrode paste during the baking process. To compensate for the consumption of the electrode, the electrode is lowered downwardly into the furnace by means of electrode holding and slipping means.

When conventional electrodes of this type are used, the electrode casing and the inner ribs melt when the electrode is being consumed in the furnace. The metal content of the casing and the ribs is thus transferred to the product produced in the smelting furnace. As the electrode casing and the inner ribs usually are made from steel, such conventional self-baking electrodes can not be used for electric smelting furnaces for the production of silicon or for the production of ferro-silicon having a high silicon content, as the iron content in the produced product will become unacceptably high.

Through the years a number of modifications of the above described conventional self-baking electrode with casing and steel ribs have been proposed in order to avoid contamination of produced silicon with iron from the casing and the steel ribs.

Thus in Norwegian patent No. 149451 it is disclosed a self-baking electrode wherein an electrode paste with a tar-based binder contained in a casing having no inner vertical ribs is baked above the area where electric operation current is supplied to the electrode and where the casing is removed after baking of the electrode, but before the electrode reaches the area where electric operating current is supplied to the electrode. In this way a casing and rib free electrode can be produced. This kind of electrode has been used in smelting furnaces for the production of silicon, but has the disadvantage compared to conventional prebaked electrodes that it needs costly apparatuses for baking of the electrode as the electrode in the area of baking has to be heated to a temperature in the range of 700°–1000° C. Further, as gases containing polyaromatic hydro-carbon compounds (PAH) evolve during baking, the apparatus has to be equipped with means for collecting and destroying the PAH compounds. Finally, it has to be arranged devices for removal of the casing after the electrode has been baked.

U.S. Pat. No. 4,692,929 discloses a self-baking electrode which is useful in the production of silicon. The electrode comprises a permanent metal casing having no inner ribs and a support structure for the electrode comprising carbon fibers, where the electrode paste is baked about the support structure and where the baked electrode is held by the support structure. This electrode has the disadvantage that separate holding means have to be arranged above the top of the electrode in order to hold the electrode by means of the support structure made from carbon fibers.

U.S. Pat. No. 4,575,856 discloses a self-baking electrode having a permanent casing having no inner ribs where the electrode paste is baked about a central graphite core and where the electrode is held by the graphite core. This electrode has the same disadvantage as the electrode disclosed in U.S. Pat. No. 4,692,929, but in addition the graphite core is subjected to breakage when the electrode is subjected to horizontal forces.

The above mentioned methods for producing self-baking electrodes having no inner metal ribs all have the disadvantage that they can not be used for electrodes having a diameter above about 1.2 m without a substantially increased risk of electrode breakage. In contrast, conventional self-baking electrodes may have a diameter of up to 2.0 m.

In the production of all the above mentioned types of carbon electrodes it is used a carbonaceous electrode paste comprising a particulate solid carbon material, preferably anthracite, and a tar-based binder. This electrode paste is solid at room temperature. Upon heating, the paste starts to soften at a temperature in the range of 50°–150° C. as the tar-based binder starts to melt at this temperature. Upon further heating to about 500° C. the paste starts to bake, and a complete baking to a solid carbonaceous body takes place at a temperature above about 800° C.

DISCLOSURE OF INVENTION

In spite of the above mentioned methods and apparatuses for production of self-baking electrodes in order to avoid iron contamination of the product which is produced in the furnace, there is still a need for a reliable method and apparatus for production of self-baking carbon electrodes whereby the disadvantages of the known methods can be overcome.

Accordingly, the present invention relates to a method for continuous production of a self-baking carbon electrode in direct connection with the smelting furnace wherein the electrode is consumed, said method being characterized in that blocks of a first unbaked carbonaceous electrode paste are supplied to a curing chamber arranged at the upper end of the electrode, which curing chamber is open at its top and at its bottom and has an inner cross-section corresponding to the cross-section of the electrode which is to be produced, said blocks of the first unbaked carbonaceous paste having a smaller diameter than the inner diameter of the curing chamber, supplying a second particulate unbaked carbonaceous electrode paste to the annulus between the curing chamber and the blocks of the first unbaked carbonaceous electrode paste, said second electrode paste comprising a binder which cures at a lower temperature than the first carbonaceous electrode paste, heating and curing the second carbonaceous paste by means of heating means arranged on the curing chamber, whereby the second carbonaceous electrode paste forms a cured shell about the central blocks of the first carbonaceous electrode paste, and that the central unbaked blocks of the first carbonaceous electrode paste are baked into a solid carbon electrode together with the cured shell by means of the heat generated in the area of electric current supply to the electrode.

In order to form the annulus between the curing chamber and the blocks of the first unbaked electrode paste, cylinder-shaped blocks of the first unbaked electrode paste are preferably supplied, but blocks having another cross-section than circular cross-section, such as blocks having oval, quadratic or rectangular cross-sections can also be used.

According to a preferred embodiment the blocks of this first carbonaceous electrode paste contain a tar-based binder, while the second carbonaceous electrode paste contains a resin-based binder which cures at a temperature below 500° C. By heating of the second carbonaceous paste to the curing temperature, the first electrode paste containing the tar-based binder will remain substantially unaffected.

By the method of the present invention, during curing of the second carbonaceous electrode paste in the area of the curing chamber, a cured shell of the second carbonaceous paste, which shell has a sufficient strength to allow the electrode to be held and slipped by means of conventional electrode holding and slipping equipment when the electrode enters below the curing chamber. The cured shell of the second carbonaceous electrode paste will further have a sufficient electric and thermal conductivity in order to supply electric current via conventional current supply means which are used for self-baking carbon electrodes. In the area of electric current supply, the cured shell of the second electrode paste will then be baked at a high temperature at the same time as the blocks of the first electrode paste are baked into solid carbon. A monolithic solid carbon electrode is thereby formed in the area of current supply.

The thickness of the cured shell of the second electrode paste is adjusted according to the electrode diameter with an increased shell thickness with increased electrode diameter. It is, however, preferred that the cured shell of the second electrode paste is formed has a minimum thickness of 1 cm. The cured shell has, however, normally a thickness of at least 5 cm and preferably above 10 cm.

According to another embodiment, the present invention relates to an apparatus for continuously production of a self-baking electrode in direct connection with a smelting furnace wherein the electrode is being consumed, the apparatus comprising holding and slipping means for the electrode and means for supplying electric operating current to the electrode, said apparatus being characterized in that it further comprises a curing chamber arranged at the upper end of the electrode, which curing chamber has an open top and an open bottom and has an inner cross-section corresponding to the cross-section of the electrode to be produced, which curing chamber is affixed to the electrode holding- and slipping means and is equipped with heating means for heating the curing chamber to a temperature sufficiently high to provide a cured shell of electrode paste on the inside of the curing chamber.

According to a preferred embodiment the heating means comprises at least two separate heating means arranged vertically in relation to each other.

According to another preferred embodiment the heating means comprises a plurality of electric resistance heating elements.

The curing chamber is affixed to the electrode holding- and slipping means. Thus by slipping of the electrode the electrode is moved down through the curing chamber. The curing chamber is preferably affixed to the electrode holding- and slipping means in such a way that the distance between the curing chamber and the electrode holding and slipping means is kept constant. This gives a simple and reliable design which needs little maintenance. In some cases it may be of advantage to affix the curing chamber to the electrode holding- and slipping means in such a way that the distance between the lower end of the curing chamber and the electrode holding- and slipping means can be adjusted. This can be done by affixing the curing chamber by means of rails comprising hydraulic or pneumatic cylinders.

The curing chamber can be made from any material which can be used at a temperature above 500° C. The curing chamber is preferably made from a metal such as steel, or from a ceramic material. As ceramic material it is preferred to use ceramic materials having high thermal conductivity.

In order to prevent sticking of electrode paste to the inside of the curing chamber, the inside of the curing chamber can be lined with a suitable material in order to reduce sticking and friction between the inside of the curing chamber and the second electrode paste. Examples of such material are polytetrafluretylene, silicones, ceramic lining and polished steel.

The method and the apparatus according to the present invention show a number of advantages compared to conventional self-baking electrodes and also compared to other prior art self-baking electrodes. The produced electrodes give no contamination from electrode casing or ribs and can therefore be used in production of silicon and other products where iron would contaminate the products. The cured shell of the second electrode paste gives a stable outer part of the electrode without causing problems such as inconstant material properties caused by segregation which conventionally takes place in electrodes which are based on electrode paste containing only tar-based binder. The cured shell of the second electrode paste further gives an improved safety against so-called soft paste electrode breakage compared to the steel casing used in connection with conventional self-baking electrodes. As the blocks of the first electrode paste do not melt and bake until they reach the area of electric current supply to the electrode, the electrode will be closed above the area where the first electrode paste melts. The gases including PAH compounds, which evolve during baking of the first electrode paste will thus not escape to the environment. PAH pollution its thereby avoided by the method of the present invention.

The thickness of the cured shell of the second electrode paste can be adjusted according to the electrode diameter, the kind of furnace and the current density and can be optimalized for each electrode. This adjustment is made by selecting a proper diameter of the blocks of the first electrode paste.

A further substantial advantage of the present invention is that there are no requirements with respect to the flow properties of the first electrode paste, and the first electrode paste can therefore be selected to give optimum properties of the baked electrode without the need to pay attention to the flow properties of the paste. For tar-based electrode paste, the amount of binder in the paste can thus be reduced.

DETAILED DESCRIPTION OF PREFERRED EMBODIMENTS

Figure 1:
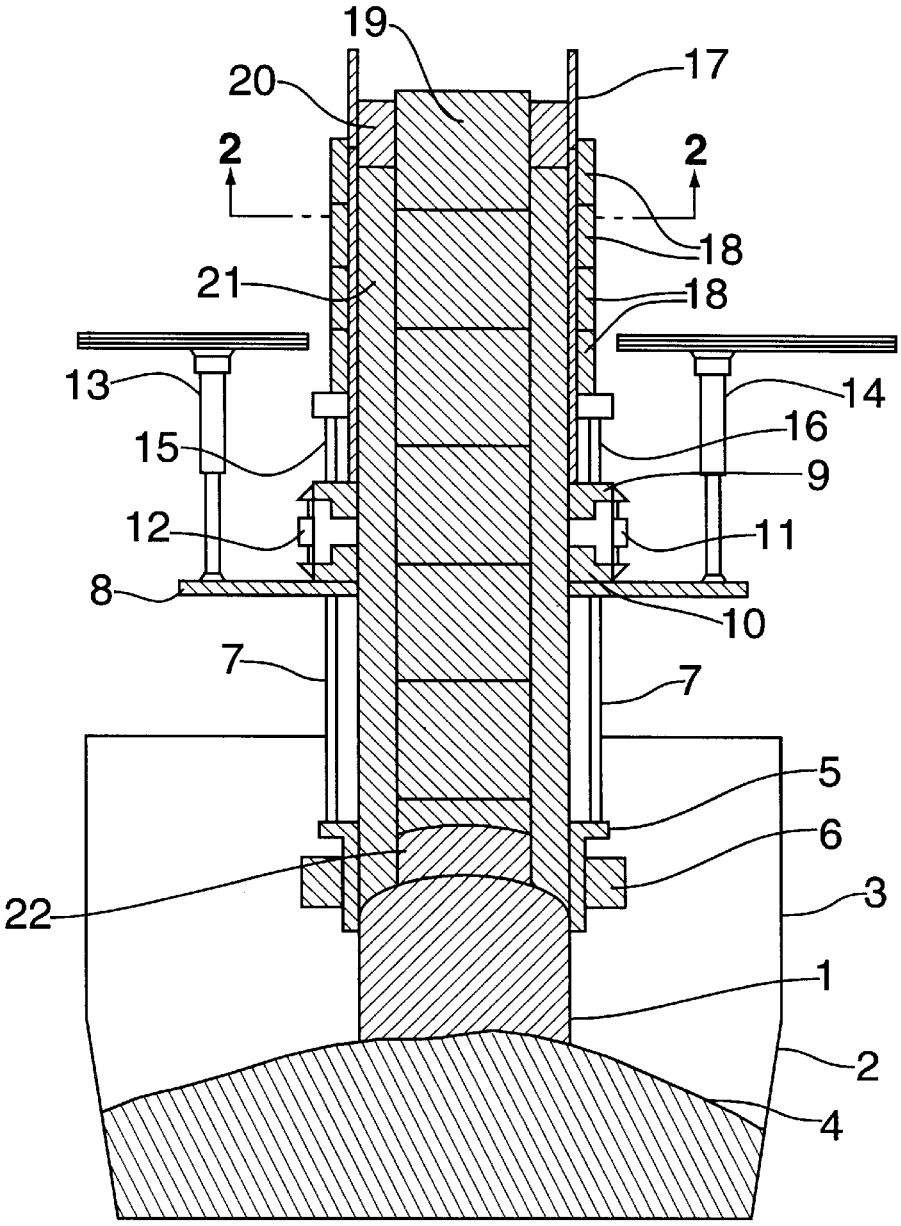
FIG. 1 is a schematic view of an electrode according to the present invention in an electric smelting furnace.
Figure 2:
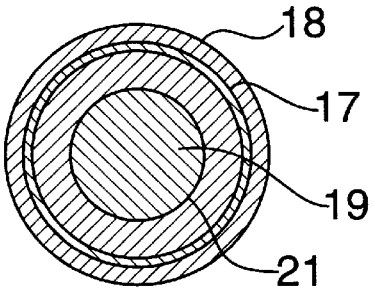
FIG. 2 is a cross-section along line I—I in FIG. 1, and where.

FIG. 1 shows an electrode 1 in an electric smelting furnace 2. The smelting furnace 2 is equipped with a smoke hood 3 and the charge level in the furnace 2 is indicated by reference numeral 4. Contact clamps for supply of electric current to the furnace are schematically shown by reference numeral 5. The contact clamps 5 are pressed against the electrode by means of a pressure ring 6. The contact clamps 5 and the pressure ring 6 are in a conventional way equipped with internal channels for circulation of a cooling fluid. The contact clamps 5 are via rods 7 suspended from an electrode frame 8.

The electrode frame 8 is in an conventional way suspended in the furnace building by means of hydraulic electrode regulation cylinders 13 and 14. On the electrode frame 8 there is arranged electrode holding- and slipping rings 9,10 for the electrode 1. The upper electrode holding- and slipping ring 9 can be moved in the vertical direction by means of hydraulic or pneumatic cylinders 11 and 12.

A curing chamber 17 is affixed to the upper electrode holding- and slipping ring 9 by means of a number of rails 15,16. The curing chamber 17 thus constitutes the top of the electrode column. The curing chamber 17 is open at its top and at its bottom and has an inner cross-section corresponding to the cross-section of the electrode to be produced. When the holding- and slipping ring 9 is released from the electrode 1 and lifted by means of the cylinders 11, 12, the curing chamber 17 will be lifted relative to the electrode. When the holding- and slipping ring 9 is reconnected to the electrode 1 in its upper position and moved downwardly by means of the cylinders 11,12 and with the holding- and slipping ring 10 released from the electrode, the electrode 1 together with the curing chamber 17 will be moved downwards in vertical direction. In the same way as for conventional electrodes the slipping is effected in order to move the electrode downwards at the same rate as the electrode is being consumed in the smelting furnace 2. Alternatively the curing chamber 17 can be affixed to the electrode frame 8. Also in this case slipping of the electrode will move the electrode downwards in relation to the curing chamber 17.

The curing chamber 17 is equipped with a heating means 18. The heating means 18 preferably comprises a number of independent sections as shown in FIG. 1 where the temperature for each section can be regulated independent from the other sections. In the embodiment shown in FIG. 1 the heating means 18 comprises four sections, but the number of sections can be more or less than four. The heating means 18 comprises preferably one or more electric resistance heating elements, but other kind of heating means can be used such as for example induction heating, convection heating, gas firing and others.

For production of the electrodes according to the present invention cylindrical shaped blocks 19 of the first unbaked electrode paste in the center of the electrode are preferably used. The blocks 19 of the first electrode paste are placed one upon the other in the center of the curing chamber 17. There is, however, no need for exact centering of one block relative to the other. Further, there is no need to affix the individual blocks 19 to each other. The blocks 19 of the first electrode paste have a diameter which is less than the inner diameter of the curing chamber 17, whereby an annulus is formed between the curing chamber 17 and the blocks 19 of the first electrode paste.

The blocks 19 of the first electrode paste are preferably made from an electrode paste comprising a tar-based binder.

A second electrode paste 20 containing a binder which cures at a lower temperature then the first electrode paste is supplied to the annulus between the blocks 19 of the first electrode paste and the curing chamber 17. The second electrode paste 20 is supplied in the forms of particles, paste or briquettes.

The second electrode paste 20 is heated by means of the heating means 18 to such a temperature that the second electrode paste is cured while the blocks 19 of the first electrode paste remains substantially unaffected. A cured shell 21 of the second electrode paste 20 is thereby formed about the blocks 19 of the first electrode paste. As the electrode is being consumed in the smelting furnace 2, the electrode 1 is being slipped downwards by means of the holding- and slipping rings 9, 10, and as the curing chamber 17 is affixed to the electrode frame 8, the cured shell 21 of the second electrode paste 20 is moved out of the lower end of the curing chamber 17 as the electrode is slipped.

The cured shell 21 has a sufficient strength to hold the electrode by means of the holdings and slipping rings 9,10.

When the electrode enters the area of the contact clamps 5 where electric operating current is supplied to the electrode, the cured shell 21 of the second electrode paste 20 will be heated and conduct heat radially into the electrode. The blocks 19 of the first electrode paste will thereby melt and form a liquid phase 22 which is then baked into solid carbon. In this area the finished baked electrode is produced.

As the blocks 19 of the first electrode paste are melted and baked in the area of the contact clamps 5, PAH containing gases which evolve during the baking will not be able to escape to the environment outside of the electrode. By use of the present invention the environmental problem of PAH containing gases is thereby eliminated.

As set out above, the heating means 18 preferably comprises a number of heating elements with separate temperature regulation. The temperature is then regulated in order to have the lowest temperature in the highest arranged heating element and the highest temperature in the lowest arranged heating element.

By use of a second electrode paste 20 comprising a novolac resin binder with a curing temperature of about 400° C. and by the use of four heating elements, the temperature in the individual heating elements may advantageously be adjusted in such a way that the temperature is regulated, from the upper to the lower heating elements within the range of 50°–100° C., 100°–200° C., 200°–300° C. and 300°–400° C.

In this way a gradual heating of the second electrode paste 20 is obtained and ensures that a cured shell 21 of the second electrode paste 20 has been formed when the electrode moves out from the curing chamber 17. The blocks 19 of the first electrode paste are substantially unaffected during the heating in the curing chamber 17 as the temperature only will provide a local softening on the surface of the blocks 19. The blocks 19 will thereby maintain their shape and provide a formwork for the formation of the cured shell 21 of the second electrode paste 20.

Figure 3:
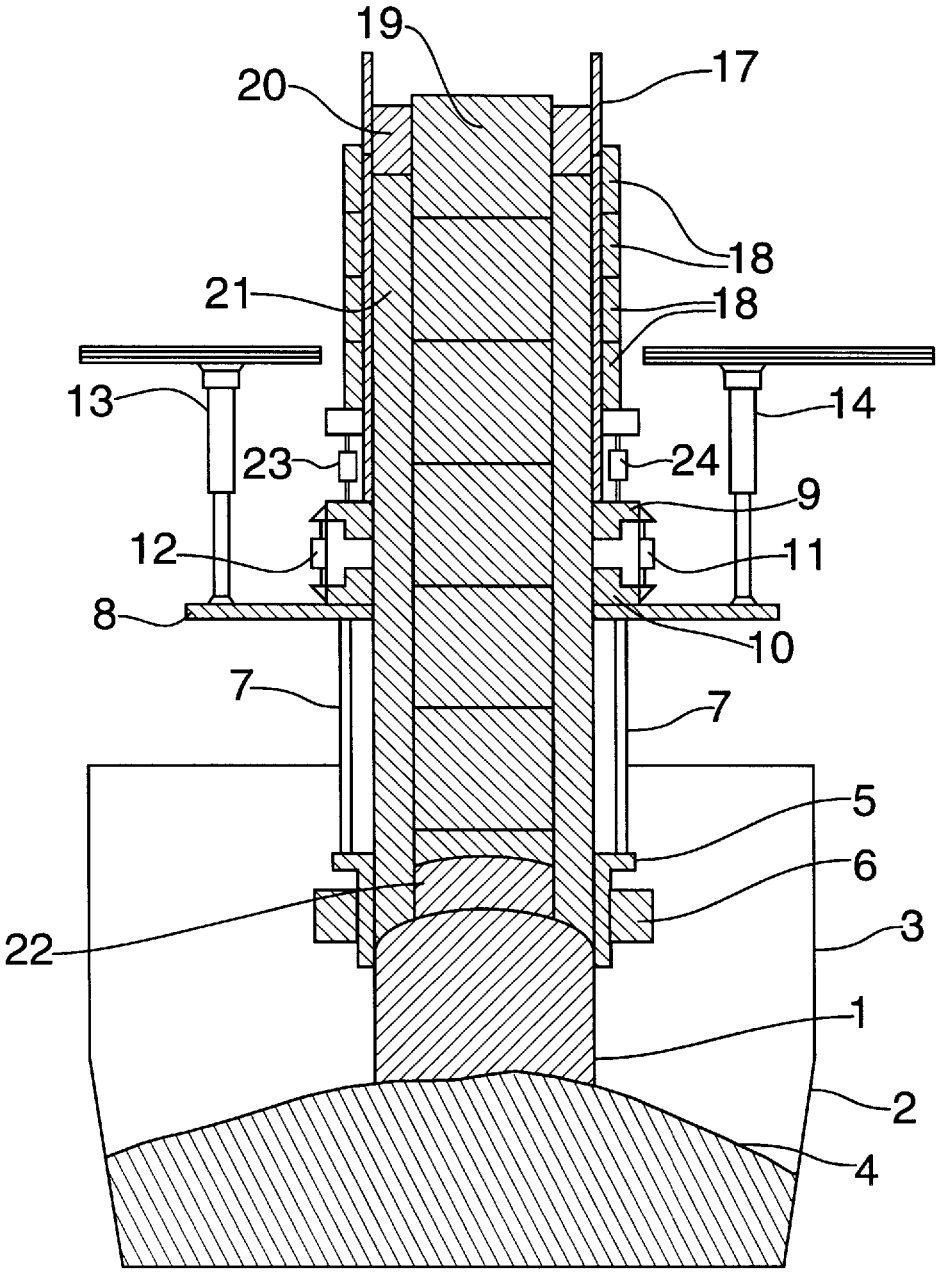
FIG. 3 shows a second embodiment of an apparatus according to the present invention.

In FIG. 3 there is shown a second embodiment of the apparatus according to the present invention. Parts on FIG. 3 corresponding to parts on FIG. 1 have been given the same reference numerals.

The apparatus shown in FIG. 3 only differs from the apparatus shown in FIG. 1 in that the curing chamber 17 is adjustably affixed to the holding- and slipping ring 9. In the apparatus shown in FIG. 3 the curing chamber 17 is affixed to the holding- and slipping ring 9 by means of hydraulic or pneumatic cylinders 23, 24. The distance between the lower end of the curing chamber 17 and the holding- and slipping ring 9 can be adjusted by movement of the cylinders 23, 24. This can be of advantage when the electrode consumption is high, such as for example in connection with an electrode breakage in the smelting furnace. An additional length of electrode can then be slipped down by reducing the distance between the lower end of the curing chamber 17 and the holding- and slipping ring 9 by means of the cylinders 23, 24.

In normal electrode operation, the temperature in each heating element will be kept substantially constant. In abnormal electrode operation such as for example in connection with high electrode consumption rate, the temperature can be increased in order to increase the curing rate of the second electrode paste 20.

The electrode produced according to the present invention can be installed in smelting furnaces where conventional self-baking electrodes are used today and also in furnaces using prebaked carbon electrodes of graphite electrodes, as existing holding- and slipping equipment and electric current supply means can be used without modifications.

I claim:

1. A method for continuous production of a self-baking electrode (1) in direct connection with a smelting furnace wherein the electrode is consumed, comprising the steps of:

supplying blocks (19) of a first unbaked carbonaceous electrode paste to a curing chamber (17) arranged at the upper end of the electrode (1), which curing chamber (17) is open at its top and at its bottom and has an inner cross-section corresponding to the cross-section of the electrode (1) which is to be produced, the blocks (19) of the first unbaked carbonaceous paste having a smaller diameter than the inner diameter of the curing chamber (17), such that an annulus is formed between the blocks (19) of the first unbaked carbonaceous electrode paste and the inner diameter of the curing chamber (17);

supplying a second particulate unbaked carbonaceous electrode paste (20) to the annulus between the curing chamber (17) and the blocks (19) of the first unbaked carbonaceous electrode paste, the second electrode paste (20) comprising a binder which cures at a lower temperature than the first carbonaceous electrode paste;

heating and curing the second carbonaceous paste (20) by means of heating means (18) arranged on the curing chamber (17), whereby the second carbonaceous electrode paste (20) forms a cured shell (21) about the blocks (19) of the first carbonaceous electrode paste, and the blocks (19) of the first carbonaceous electrode paste are baked into a solid carbon electrode (1) together with the cured shell (21) by means of the heat generated by the electric current supply (5) to the electrode.

2. The method according to claim 1, wherein the blocks (19) of the first carbonaceous electrode paste contain a tar-based binder and the second carbonaceous electrode paste (20) contains a resin-based binder which cures at a temperature below 500° C.

3. The method according to claim 1, wherein the blocks (19) of the first unbaked electrode paste are cylindrically or substantially cylindrically shaped.

4. The method according to claim 1, wherein the blocks (19) of the first electrode paste have such a cross-section that the annulus formed between the curing chamber (17) and the blocks (19) of the first electrode paste has a thickness of at least 1 cm.

5. The method according to claim 4, wherein the blocks (19) of the first electrode paste have such a cross-section that the annulus formed between the curing chamber (17) and the blocks (19) of the first electrode paste has a thickness of at least 5 cm.

6. An apparatus for continuous production of a self-baking electrode (1) in direct connection with a smelting furnace wherein the electrode is being consumed, the apparatus comprising electrode frame (8), upper holding and slipping means (9) and lower holding and slipping means (10) for the electrode and means (5) for supplying electric operating current to the electrode, wherein the apparatus further comprises a curing chamber (17) arranged at the upper end of the electrode (1), which curing chamber (17) has an open top and an open bottom and has an inner cross-section corresponding to the cross-section of the electrode (1) to the produced, which curing chamber (17) is affixed directly to the upper holding and slipping means (9) and is equipped with heating means (18) for heating the curing chamber (17) to a temperature sufficiently high to provide a cured shell (21) of electrode paste on the inside of the curing chamber (17).

7. The apparatus according to claim 6, wherein the curing chamber (17) is affixed to the upper holding and slipping means 9 by hydraulic or pneumatic cylinders (23, 24) in order to adjust the position of the curing chamber (17) in relation to the upper holding and slipping means 9.

8. The apparatus according to claim 6, wherein the heating means (18) is selected from the group consisting of electric heating means, induction heating means, convection heating means and gas fired heating means.

9. The apparatus according to claim 6, wherein the heating means (18) comprises at least two separate heating means arranged vertically in relation to each other.

10. The apparatus according to claim 6, wherein the heating means (18) comprises a plurality of electric resistance heating elements.

11. The apparatus according to claim 6, wherein the inside wall of the curing chamber (17) is lined with a material which reduces the friction between the inside of the curing chamber (17) and the electrode paste supplied to the curing chamber (17).

12. The apparatus of claim 6, wherein the curing chamber (17) is affixed to the upper holding and slipping means (9) by rails (15, 16).

* * * * *